United States Patent [19]

Winston et al.

[11] 4,265,790

[45] May 5, 1981

[54] METHOD OF PREPARING A DRY BLENDED LAUNDRY DETERGENT CONTAINING COARSE GRANULAR SILICATE PARTICLES

[75] Inventors: Anthony E. Winston, East Brunswick; Francis R. Cala, North Brunswick; Stephen P. Lengyel, Bridgewater; Lawrence Kirschner, Flanders; Dragomir Bracilovic, Edison, all of N.J.

[73] Assignee: Church & Dwight Co., Inc., Piscataway, N.J.

[21] Appl. No.: 65,203

[22] Filed: Aug. 9, 1979

[51] Int. Cl.[3] ..... C11D 17/06; C11D 3/08; C11D 3/10

[52] U.S. Cl. ..... 252/532; 252/135; 252/540

[58] Field of Search ..... 252/135, 99, 532, 539, 252/540

[56] References Cited

U.S. PATENT DOCUMENTS

| | | | |
|---|---|---|---|
| 3,687,640 | 8/1972 | Sams et al. | 252/135 X |
| 3,918,921 | 11/1975 | Pierce | 252/135 X |

*Primary Examiner*—Harris A. Pitlick

*Attorney, Agent, or Firm*—Cushman, Darby & Cushman

[57] ABSTRACT

Dry blended carbonate or phosphate-based laundry detergents are prepared by adding to unhydrated or partially hydrated builder salts, a pH buffering compound and a detergent active compound, together with other formulating agents, coarse, hydrous granular water soluble silicate particles, the silicate particles passing a 10 mesh screen and about 95% of the particles are retained on a 100 mesh screen, according to the disclosed method. Dry blended laundry detergents so formulated are substantially completely free of insoluble product lumps when used in cold wash water in the temperature range of 35°–75° F.

6 Claims, 4 Drawing Figures

METHOD OF PREPARING A DRY BLENDED LAUNDRY DETERGENT CONTAINING COARSE GRANULAR SILICATE PARTICLES

BACKGROUND OF THE INVENTION

This invention is directed to and describes dry blended laundry detergents, typically of the home use type, and the materials so produced, containing unhydrated or partially hydrated hydratable salts. As classes, the carbonate-based and phosphate-based laundry detergents may be mentioned. These products, which contain unhydrated or partially hydrated hydratable salts, perform well and have been widely sold and accepted. However, when used in cold water (for example, wash water temperatures of 75° F. or less), such dry blended detergents tend to form lumps in the wash water, which lumps are only slowly soluble. As a result, efficacy may be lost since the active ingredients are not fully in solution. In addition, lumps may sometimes be present at the completion of the washing process, giving cause for user concern.

It has been surprisingly discovered that this efficacy and lumping problem can be substantially eliminated by replacing the fine, granulated silicate powder normally used in dry blended detergent with a coarse, granular silicate powder.

DETAILS OF THE INVENTION

Dry Blending Of Detergents

The dry blending approach to detergent manufacture is distinct from and is advantageous over the spray drying procedure as it is more convenient and requires less total energy to produce a final product. The capital investment for dry blending equipment is also significantly lower than that required for spray drying.

One disadvantage of dry blended detergents relative to spray dried detergents is that the former must be formulated with careful attention to the physical size and shape of its ingredients. A properly formulated dry blended detergent will be homogeneous and not exhibit a tendency to segregate particles or become unmixed on shipping or handling. On the other hand, improperly formulated dry blended detergents may well never be homogeneous or may segregate quickly and to great extent during shipping and handling.

The normal approach to avoiding segregation is to choose all dry raw materials to have substantially the same particle size and density. If one dry ingredient has unusually large or small particle size compared to the balance of the formula, it often will segregate, causing the product to perform improperly in its end use.

Following this guideline, a dry blended detergent made from finely divided powders would require use of finely divided silicate particles to avoid silicate segregation. However, we have found that these finely divided silicates lead to the aforementioned efficacy and lumping problem.

Surprisingly we found that replacement of the fine, granular silicate by coarse, granular silicate substantially eliminates this problem. Although this replacement is contrary to the normal rules of formulation, it does not create too great a penalty in segregation. The silicate particles used in the method of our invention are substantial in size as compared with conventional laundry detergent applications and are characterized in size by all or virtually all particles passing through a 10 mesh screen, about 95% to 100% of the particles being retained on 100 mesh screen and no more than about 4% passing through a 100 mesh screen. As used herein, the screen size is U.S. screen or sieve size. Granular alkali metal silicates have been used in the past in laundry detergent formulations usually in the form of sodium silicate, however the particle sizes employed were much smaller, for instance 80% or more passing through 100 mesh. By comparison, the preferred soda ash used in dry blended detergents has a similar fine particle size, such that about 75% passes through 100 mesh screen.

Details of Chemical Formulation

Detergent formulations based upon hydrated or partially hydrated hydratable salts, typically carbonates and phosphates, are themselves well known.

The detergent formulations produced by the method of our invention may include one or more synthetic detergent active compounds; one or more builder salts which include carbonates, phosphates, pyrophosphates or glassy phosphates; alkali metal silicates, hydrous form; one or more pH buffering compounds which include alkali metal bicarbonates and sesquicarbonates; agents such as percarbonates or perborates; and the usual detergent formulation ingredients such as perfume, brighteners, anti-redeposition agents, soil-suspenders, fillers (such as sodium sulfate) and the like; all as described in detail below.

As the surfactant component of a laundry detergent formulation, one can use one or more of many suitable synthetic detergent active compounds which are commercially available and described in the literature, for example, in "Surface Active Agents and Detergents", Volumes 1 and 2 by Schwartz, Perry and Berch. Several detergents and synthetic detergent active compounds are also described in the following U.S. Pat. Nos., the relevant disclosures of which are hereby incorporated by reference: 3,957,695; 3,865,754; 3,932,316 and 4,009,114. Generally stated, the detergent component may include a synthetic anionic, nonionic, amphoteric or zwitterionic detergent active compound, or mixtures of two or more of such compounds.

We prefer to use a mixture of nonionic and anionic detergent compounds.

Specific nonionic detergent active compounds which can be used in the compositions of the present invention include ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles EO per mole of alkyl phenol. The non-ionic compounds mentioned above are often used in admixture with amounts of other detergent active compounds, especially anionic compounds, to modify the detergency, soil redeposition, lather characteristics, powder and physical properties of the overall formulation.

The preferred class of nonionic detergent active compounds are the ethoxylated linear alcohols, such as the $C_{12}$–$C_{16}$ alcohols ethoxylated with an average of from about 1 to about 12 moles of ethylene oxide. A most preferred nonionic detergent is a $C_{12}$–$C_{15}$ alcohol ethoxylated with 3 moles of ethylene oxide.

The preferred water soluble anionic detergent compounds are the alkali metal (such as sodium and potassium) salts of the higher linear alkyl benzene sulfonates and the salts of sulfonated ethoxylated fatty alcohols. The particular salt will be suitably selected depending upon the particular formulation and the proportions therein.

The sodium alkylbenzenesulfonate surfactant (LAS) most preferably used in the composition of the present invention has a straight chain alkyl radical of average length of about 11 to 13 carbon atoms.

Specific sulfated ethoxylated detergent active compounds which can be used in the compositions of the present invention include sulfated ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and sulfated ethoxylated alkylphenols with $C_8$–$C_{16}$ alkyl groups, preferably $C_8$–$C_9$ alkyl groups, and on average from 4–12 moles per mole of alkyl phenol.

The preferred class of sulfated ethoxylated detergent active compounds are the sulfated ethoxylated linear alcohols, such as the $C_{12}$–$C_{16}$ alcohols ethoxylated with an average of from about 1 to about 12 moles of ethylene oxide. A most preferred sulfated ethoxylated detergent is made by sulfating a $C_{12}$–$C_{15}$ alcohol ethoxylated with 3 moles of ethylene oxide.

For a laundry detergent, the effective amount of the detergent active compound or compounds of the present invention is generally in the range of from about 5 to about 30% by weight and preferably from about 5 to about 20% by weight of the composition. The choice of a particular detergent active compound or mixture of compounds will, of course, vary but within the stated ranges.

As the builder component, the detergent formulations of the present invention include inorganic unhydrated or partially hydrated hydratable salts of the type typically used in dry blended detergent formulations. They include the alkali metal carbonates, tripolyphosphates, pyrophosphates, hexametaphosphates, borates; and silicates of the specific type and physical size as mentioned above. Specific examples are the sodium and potassium carbonates and sodium tripolyphosphates. Generally, at least one third of the detergent formulation is anhydrous sodium carbonate (soda ash) or sodium tripolyphosphate, or their mixture. The specific sodium silicate used is normally present in the 3 to 10% range to decrease the possibility of corrosion of metal and porcelain parts in laundry washing machines. It is also used to provide mechanical strength to spray dried beads (not an object of this invention) and to provide some level of cleaning action. The sodium silicate is in the form of hydrous sodium silicate granules, typically containing about 18% water. Granular sodium silicates are also available in anhydrous form, but these are not typically used in home laundry detergents. The ratio of $SiO_2$ to $Na_2O$ for the instant silicates is of the order of about 1:1 to 3.5:1, with 2:1 to 2.4:1 being the most common range. Other detergent builders may be present in minor amounts.

Laundry detergents designed for home use may contain pH buffering agents to keep concentrated solution pH below 11.0 to reduce safety hazards in case of accidental eye contact or ingestion. Laundry detergents built with phosphate builders typically have solution pH's (1% solution in distilled water) about 9.9–10.1. Carbonate built detergents that contain lower levels of carbonate (15–30%) typically have solution pH's of 10–10.6. Neither the phosphate nor low level carbonate built detergents need pH buffer agents. However detergents that contain high levels of carbonate (30–70%) can have a solution pH between 10.6–11.2 or above. Buffer agents or acidic materials can be added to these detergents to reduce solution pH for the aforementioned safety reasons. Such buffer agents include the alkali metal bicarbonate (e.g. sodium or potassium bicarbonate) and alkali metal sesquicarbonates (e.g. sodium or potassium sesquicarbonate). Acidic materials would include citric acid and sodium acid pyrophosphate. It is the presence of these buffer of acidic compounds that accentuates gel formation on the silicate particle surfaces and makes the use of coarse, granular silicate important. These buffer or acidic compounds will normally be present in the range of 2–10% to be effective.

Apart from the detergent active compounds and detergency builders, a detergent composition of the present invention can contain any of the conventional additives in the amounts in which such additives are normally employed in fabric washing detergent compositions. Examples of these additives include lather boosters such as alkanolamides, particularly the monoethanolamides derived from palm kernal fatty acids and coconut fatty acids, lather depressants, anti-redeposition agents, such as sodium carboxymethylcellulose, oxygen-releasing bleaching agents such as sodium perborate and sodium percarbonate, peracid bleach precursors, chlorine-releasing bleaching agents such as trichloroisocyanuric acid, fabric softening agents, inorganic salts such as sodium sulfate, and usually present in very minor amounts, flourescent agents, perfumes, enzymes such as proteases and amylases, germicides and colorants.

The detergent compositions may be dry blended in any suitable type of blending equipment, e.g., a ribbon blender, Patterson Kelly twin cone blender or V-shell blender, Nauta cone mixer with orbiting screw. If desired, liquid components may be oversprayed through nozzles onto the dry blend while mixing.

Alkyl benzene sulfonate, if used, may be added as a pre-dried flake or, in the acid form, where it is neutralized in situ to form the surfactant salt.

Figure 1:
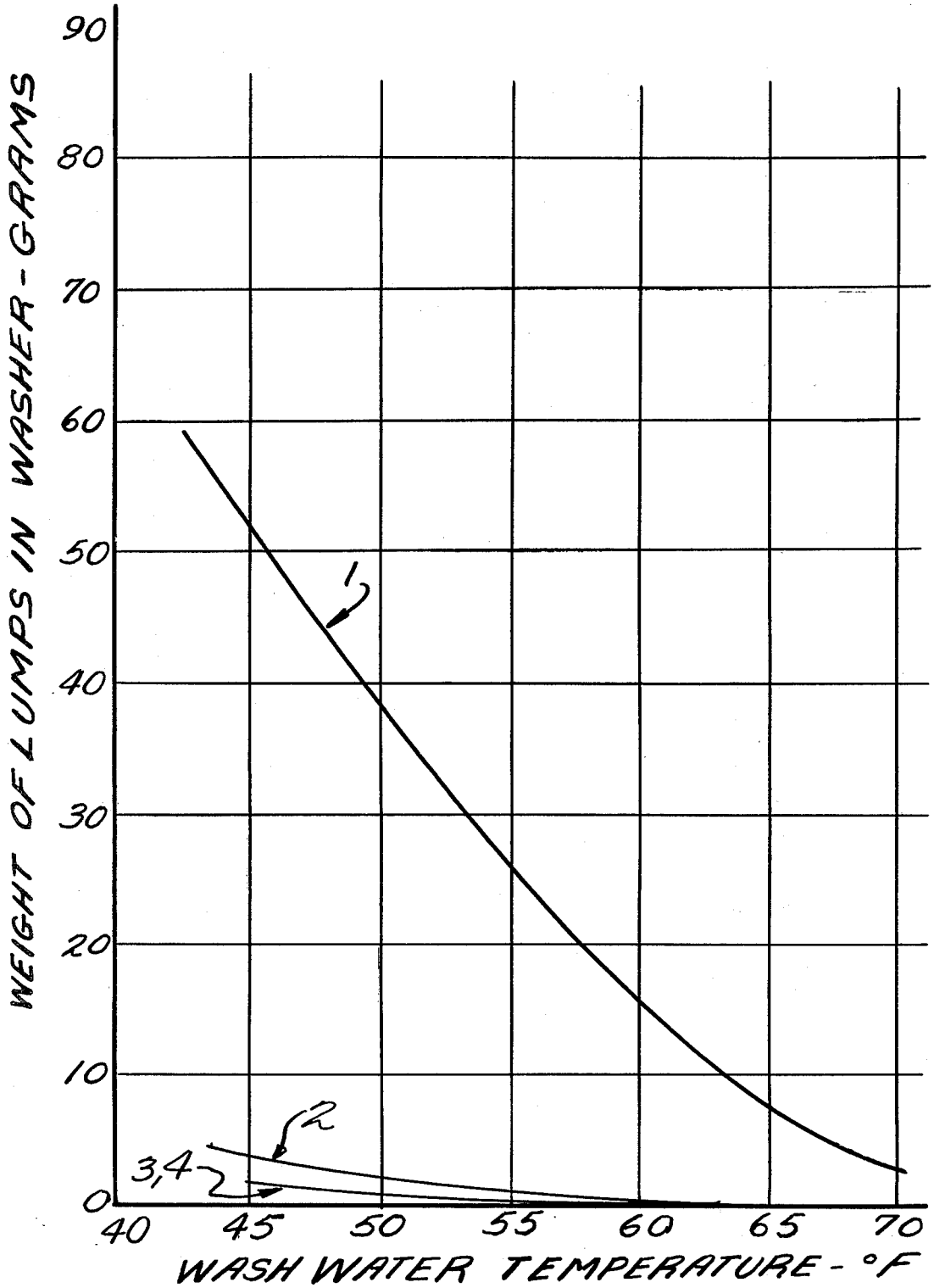
FIG. 1 is a graph showing the weight in grams of product lumps remaining in the washing machine for four different detergent formulations as a function of wash water temperature measured in °F.

While not wishing to be bound to any particular theory or mode of operation we believe that the object of our invention is achieved in a manner consistent with the following scheme: hydrous sodium silicate particles, when contacted with water, for instance cold water, tend to form a hydrated gel on their surface. The speed of gel formation is magnified if the sodium silicate is included in a detergent formulation that also contains one or more of sodium tripolyphosphate, borax, sodium bicarbonate, or sodium sesquicarbonate, or any other compound that gives a pH (in 1% aqueous solution) of 10.1 or less. Thus the hydrous sodium silicate particles may be described as forming "gel centers" to which all other components of the detergent formulation are attracted. Simultaneous with formation, the hydratable detergent salts form interlocked hydrated crystals which have relatively low solubility in cold water. Such salts include sodium carbonate which forms sodium carbonate decahydrate, sodium tripolyphosphate which forms sodium tripolyphosphate pentahydrate, sodium sulfate which forms sodium sulfate decahydrate, or sodium tetraborate which forms sodium tetraborate decahydrate (borax). The silicate gel centers tend to act as reinforcing for these hydrated salts creating a relatively hard and mechanically stable lump.

Our invention greatly reduces and in some cases eliminates the reinforcing effect of the silicate gel particles. Since this invention uses silicate particles at least one order of magnitude larger than those previously used, fewer total silicate particles will be present than previously. The reduction of total "gel centers" and separation of the "gel centers" further from each other throughout the formulation, reduces or eliminates their ability to reinforce the lump of hydrated builder salts which forms in the presence of cold water.

The results achieved include not only a more complete dissolution of the cleaning composition in the wash water, thus rendering the laundry detergent formulation more effective, but also a substantial reduction, or sometimes total elimination, of laundry detergent lumps, undissolved particles or the like remaining in the washing machine at the completion of the washing cycle.

There are a number of variables to be considered in respect of the present invention of the type identified below. The method of the invention leads to a dramatic decrease in the number of undissolved product masses or lumps remaining at the end of the wash cycle, but not necessarily complete lump elimination in all cases. Indeed the minor degree of lumping, when it exists, varies from batch to batch of the coarse silicate-containing product (it will be recalled that the dry blended detergent formulations are customarily made on a batchwise rather than continuous basis). Also, when minor lumping is observed, the degree is variable from wash to wash owing to the non-reproducibility of mechanical action within a given washing machine. Because of the above factors and in order to accurately represent the method of our invention we have in most instances conducted five tests or test runs of a sample product and examined an average of the resulting lump weights. It will be appreciated that these factors also mean that slight variations may be present in temperature curves, lump weight averages and test runs even on the same laundry detergent formulation.

DETAILED DESCRIPTION OF THE DRAWINGS

FIG. 1 is a graph illustrating the weight in grams of product lumps remaining in the washing machine from four different detergent formulations. These lumps are expressed as a function and calculated against the temperature of the wash water as measured in °F. The procedure used for this test is described preceding Example 1 in the following materials. The formulations used were as follows:

1. A dry blended detergent formulation containing fine sodium silicate particles not in accordance with the method of the present invention.
2. A dry blended detergent formulation containing coarse sodium silicate particles in accordance with the method of the present invention.
3. A spray dried detergent product, identified as "A" containing what is believed to be homogeneously mixed silicate.
4. A spray dried product also containing homogeneously mixed silicate, identified as "B".

The object of the present invention, of course, is to reduce to the extent possible, or entirely eliminate, lumps formed and remaining in the washing machine. Thus, results approaching the horizontal baseline are desirable. As can be seen from the graph the uppermost line represents an average value of five runs for a dry blended fine silicate formulation not in accordance with the present invention.

As regards the results according to the present invention, in the range of 45° to 55° F. the results were nearly comparable with those obtained with spray dried detergent formulations and upwards of 55° F. the results were, on an average basis, identical or virtually identical.

Figure 2:
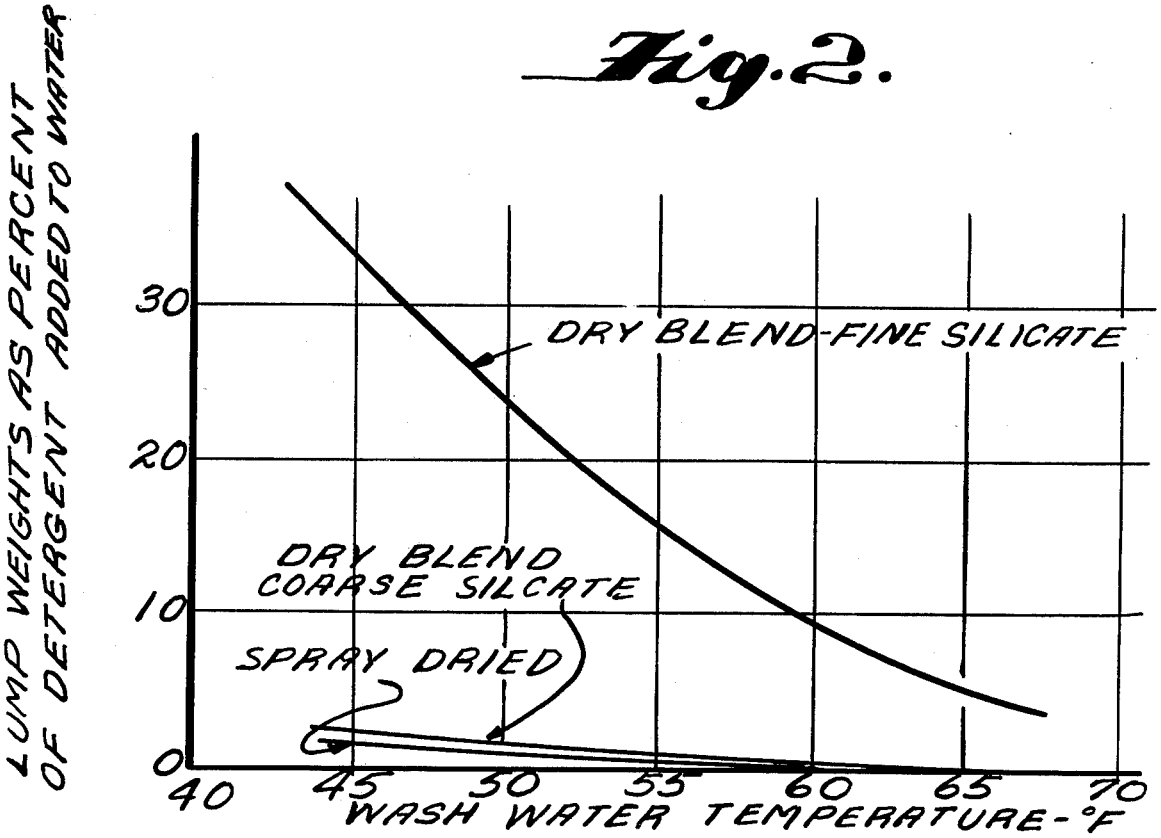
FIG. 2 is a graph depicting the average lump of undissolved particle weight for four types of detergent formulations as in FIG. 1 expressed as percent of the detergent added to the wash as a function of wash water temperature in °F.

FIG. 2 is a graph depicting the average lump weight expressed as percent of the detergent added to the wash water as a function of the wash water temperature. The results obtained are consistent with those shown in FIG. 1, in the way that the dry blended fine silicate formulation exhibited the highest weight of lumps over the temperature range whereas the dry blended, coarse silicate detergent formulation was virtually at the baseline and compared favorably with the spray dried materials. As previously discussed there are several important and substantial economies realized in the dry blending route to preparing a detergent formulation as opposed to the spray drying procedure.

Figure 3:
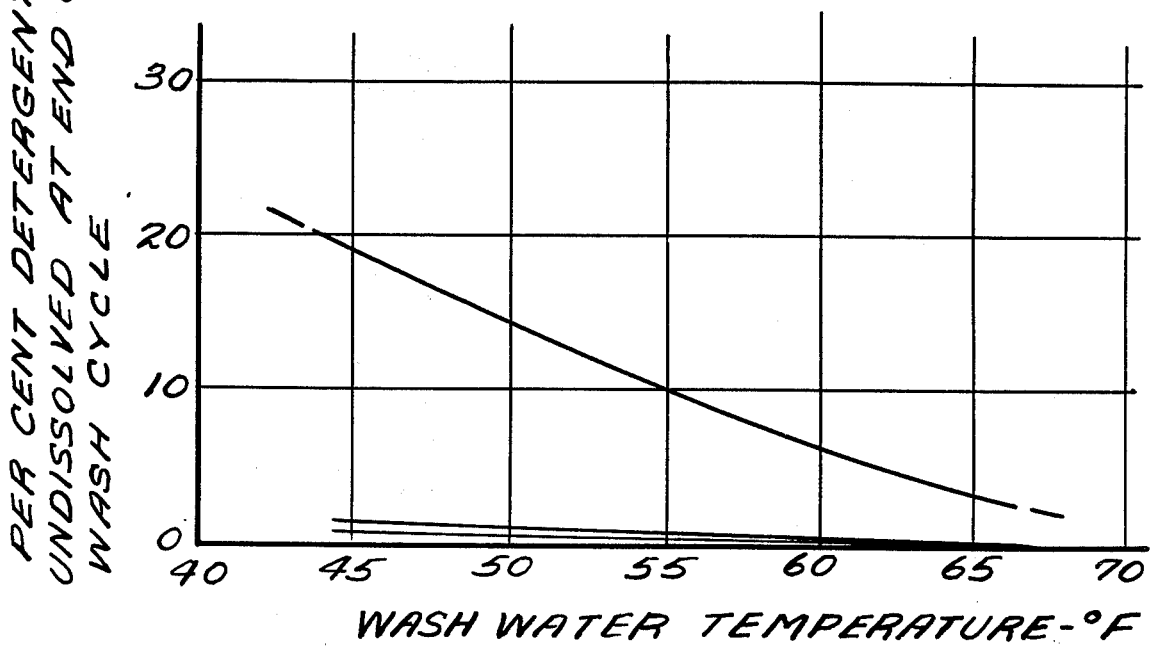
FIG. 3 is a graph derived from the data presented in FIG. 1 illustrating the percent of the same four detergent formulations undissolved at the end of the wash cycle as a function of wash water temperature in °F.

FIG. 3 is derived from the data presented in FIG. 1 and represents the percent of the detergent formulation remaining undissolved as a function of wash water temperature. This is prepared by converting the data taken from FIG. 1 by subtracting the water of hydration acquired by the formulation, principally by the hydratable builder salts. Water of hydration was measured experimentally to be about 15% of the lump weight.

Figure 4:
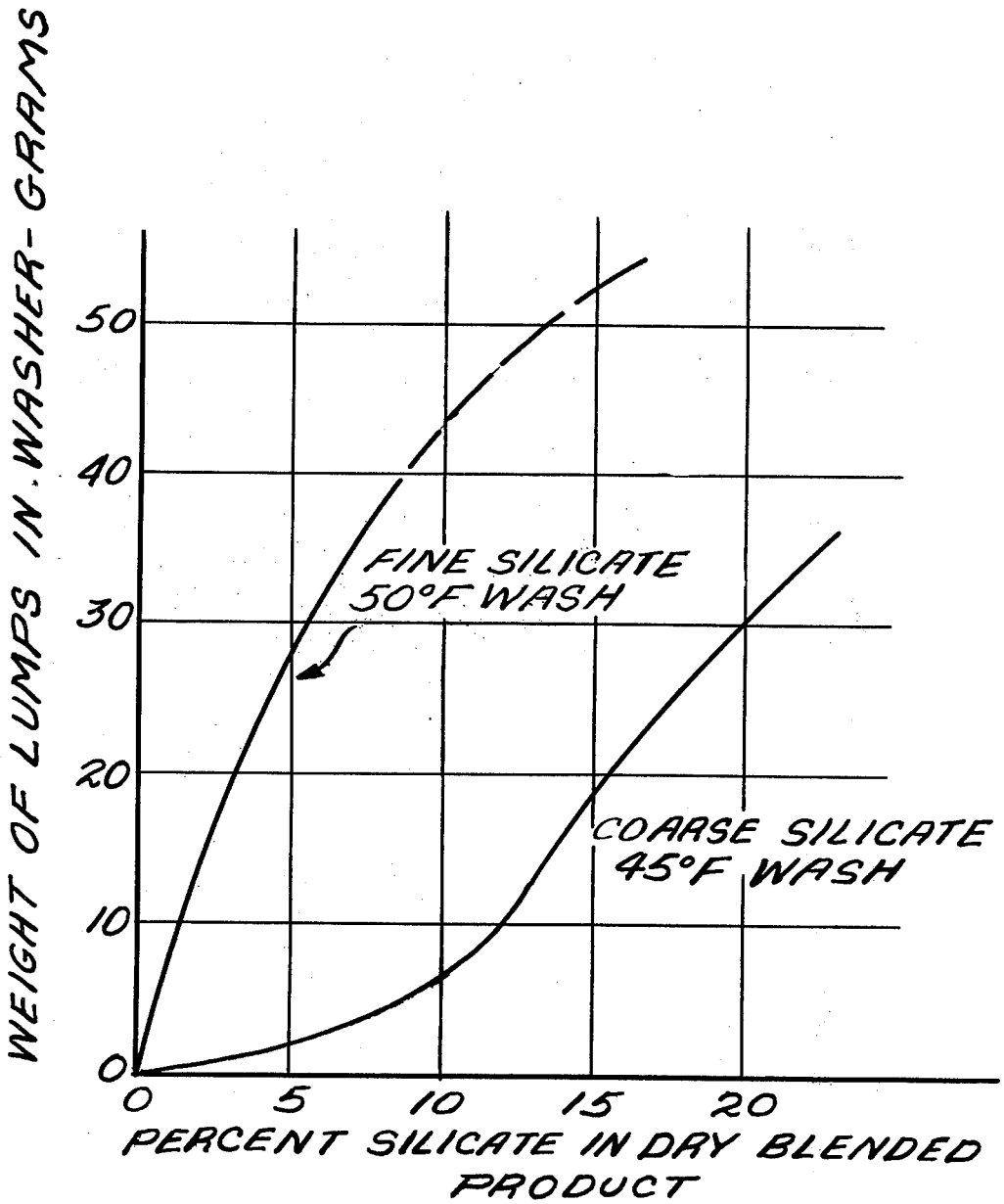
FIG. 4 is a graph showing the lump weights in grams of both coarse and fine silicates as a function of type and percent silicate in each dry blended silicate-containing product, at different wash water temperatures, as indicated.

FIG. 4 is a graph showing the lump weight in wash water as a function of the silicate type, silicate level and wash temperature in which different dry blended detergent formulations were compared, one containing fine sodium silicate the other containing coarse sodium silicate. It is not the intention of this graph to present a side-by-side comparison as between two formulations since, for instance, the temperature of the wash water was different (50° F. for the fine silicate and 45° F. for the coarse silicate). Despite this fact, the data presented clearly shows the improvement afforded by the method of the present invention by introducing coarse silicate particles of the type described herein into a dry blended laundry detergent composition.

The data contained in FIG. 4 was obtained, primarily, from the following information presented generally in tabular form. In Table I various weight percents of finely granulated sodium silicate not in accordance with this invention were testing according to the washing machine test procedure, described below. Five runs were conducted at 50° F. and the lumps obtained, if any, were measured in grams.

TABLE I

| Washing Machine Lump Weight (gm.) | | | | |
|---|---|---|---|---|
| | Silicate Content Weight % | | | |
| Run | 0% | 2% | 4% | 6.7% |
| 1 | 0 | 5.9 | 22.1 | 28.4 |
| 2 | 0 | 0 | 23.7 | 55.2 |
| 3 | 0.2 | 21.3 | 35.6 | 34.8 |
| 4 | 0 | 2.8 | 16.3 | 16.3 |
| 5 | 0 | 18.2 | 24.6 | 34.9 |
| Average | 0 | 9.6 | 24.4 | 33.9 |

Additional data supporting FIG. 4 is presented in the following table, Table II in which cold water lumping is reported for a given detergent formulation using various weight percents of coarsely granulated silicate in accordance with this invention, this time at 45° F. The results are reported in terms of grams of wet lumps accumulated.

TABLE II

| Weight of Detergent Lumps Found In Washing Machine After Washing With 45° F. Water | | | | | | |
|---|---|---|---|---|---|---|
| | Silicate Content (Weight %) | | | | | |
| Run | 4.0% | 7.3% | 11.1% | 13.3% | 15.7% | 20.1% |
| 1 | 0.69 gm. | 1.88 gm. | 6.19 gm. | 20.05 gm. | 11.24 gm. | 9.68 gm. |
| 2 | 1.62 | 2.34 | 3.41 | 14.26 | 20.01 | 57.20 |
| 3 | 1.06 | 5.67 | 1.80 | 16.76 | 26.13 | 11.99 |
| 4 | 0.92 | 1.56 | 9.62 | 9.64 | 25.45 | 67.63 |
| 5 | 3.25 | 3.77 | 5.71 | 7.31 | 28.04 | 5.11 |
| Average | 1.51 gm. | 3.04 gm. | 5.35 gm. | 13.60 gm. | 22.17 gm. | 30.32 gm. |

The sodium silicate particles used in the experiments of Table I had a particle size of 80% of the particles passing through a 100 mesh sieve; the ratio of $SiO_2$:-$Na_2O$ was 2.4. The material used was C-24 sodium silicate particles obtained from P.Q. Corporation.

The sodium silicate particles used in the experiments of Table II had a particle size of 95% of the particles being retained in a 100 mesh screen and 100% of the particles passing a 10 mesh screen; the ratio of $SiO_2$:-$Na_2O$ was 2.4. The material used was H-24 sodium silicate particles obtained from P.Q. Corporation.

Table III shows the effect of the $SiO_2/Na_2O$ ratio and particle size on cold water lumping at 56° F. with various dry blended detergent formulations. Two of the formulations contained the course silicate material according to the method of the present invention and the other three do not. For completeness, the initial weight of each sample was 160 grams and the silicate amount in each formulation was 3.88% $SiO_2$.

TABLE III

| Washing Machine Lump Size As Affected By Silicate Parameters | | | | | |
|---|---|---|---|---|---|
| $SiO_2$:$Na_2O$ Ratio | 2.4 | 2.0 | 3.22 | 2.4 | 2.0 |
| Silicate Type | Coarse Silicate | Coarse Silicate | Fine Silicate | Fine Silicate | Fine Silicate |
| Particle Size | 95% −20 mesh +100 mesh | 95% −20 +100 | 70% −20 +325 | 70% −200 +325 | 70% −200 +325 |
| Run | | | | | |
| 1 | 6.72 gm. | 6.12 gm. | 62.56 gm. | 30.98 gm. | 23.86 gm. |
| 2 | 7.15 | 3.15 | 30.86 | 34.61 | 101.70 |
| 3 | 0.01 | 18.91 | 32.29 | 48.16 | 55.54 |
| 4 | 4.40 | 7.06 | 29.80 | 19.92 | 36.84 |
| 5 | 1.42 | 5.95 | 21.94 | 45.47 | 42.30 |
| Avg. | 3.9 gm. | 8.2 gm. | 35.5 gm. | 35.8 gm. | 52.0 gm. |

EXAMPLES OF THE INVENTION

The following examples are illustrative of the invention. For convenience in presentation, LAS is linear sodium dodecylbenzenesulfonate; the nonionic surfactant is ethoxylated linear alcohol ($C_{12}$–$C_{15}$); Neodol 25-3 is a $C_{12}$–$C_{15}$ alcohol ethoxylated with 3 moles of ethylene oxide and Neodol 25-7 is a $C_{12}$–$C_{15}$ alcohol ethoxylated with 7 moles of ethylene oxide. The Neodol ingredients are nonionic surfactants manufactured by Shell Chemical Company. Coarse sodium silicate, as specifically referred to hereinbelow has a $SiO_2$:$NaO_2$ ratio of 2.4:1 and "fine" sodium silicate has a $SiO_2$:-$NaO_2$ ratio of 2.4:1, both of the indicated particle size as grades H-24 and C-24; respectively, available from the P.Q. Corporation, Philadelphia.

In the following description, examples in accordance with the present invention are numbered and comparative examples, not in accordance with the present invention, are lettered. Unless otherwise indicated, all parts and percents are by weight.

Washing machine test results

This example demonstrates the efficiency of the laundry detergent formulations produced according to the method of the present invention using coarse sodium silicate in preventing insoluble lump formation in cold water with a detergent formulation containing unhydrated sodium carbonate.

The washing machine "lump" test was conducted in the following manner: a Maytag washer at the normal setting, cold water wash/cold water rinse cycle was used. A Whirlpool dryer at the permanent press fabric cycle setting was also used to dry the washed clothes. The fabric load included one shirt, one pair of blue jeans, three bath towels, two pillow cases and one double sheet. Water conditions were at a temperature of 45° F., a hardness value of 85 ppm and the number of cycles or runs completed per formulation or test was five.

With the machine empty, the water temperature was determined as it entered the machine and adjusted to the desired temperature. This preliminary filling allows the hot and cold water valves to be adjusted for the desired temperature. A water sample is taken and a hardness test conducted. The water was next emptied from the machine without adjusting the hot and cold valve settings and the dial set to the regular wash cycle for a period of 10 minutes. The detergent formulation under test was added to the machine by making a mound in the bottom rear of the tub of the machine. Next the fabric load, identified above, was added, water turned on, and the machine was started. When full, and before agitation started, the hardness value of the wash water contained in the machine was corrected as necessary to the desired level of 85 ppm. The water temperature was recorded at intervals of 1, 5 and 9 minutes (over a 10 minute wash cycle). The machine was allowed to run through a complete cycle including wash, rinse and spin and the clothes thus washed were carefully removed from the machine by shaking them in the machine in order that any undissolved product lumps remain in the machine. Lumps remaining in the machine were collected and weighed and the weight recorded. This procedure was repeated for a total of 5 cycles and a statistical analysis was conducted on the resulting data, as indicated in several of the tables that follow.

EXAMPLE

Two dry blended laundry detergents were made by the following process according to the following method. To a 75 cubic foot Patterson Kelly V-shell blender all the below listed dry ingredients from Table A were added and blended for 30 seconds. Onto this dry mixture a blend of sulfonic acid and ethoxylated alcohol were sprayed over about 4 minutes. Perfume was sprayed on the mix for about 30 seconds and blending was continued an additional 1 minute. The finished product was discharged from the blender and conveyed to the product storage bin.

TABLE A

| | Form of Ingredient | % (Wt.) |
|---|---|---|
| soda ash | Dry | 60.0 |
| sodium bicarbonate | Dry | 5.7 |
| sodium sesquicarbonate | Dry | 18.0 |
| hydrous sodium silicate | Dry | 6.8 |
| sodium carboxymethyl cellulose | Dry | .14 |
| polyvinyl alcohol | Dry | .14 |
| optical brightener | Dry | .14 |
| sodium alkyl benzene sulfonate, flake | Dry | 2.0 |
| alkyl benzene sulfonic acid | Wet | 4.0 |
| ethoxylated long chain alcohol | Wet | 3.0 |
| perfume | Wet | .1 |
| TOTAL | Dry | 100.0 |

Formula A used PQ grade C-24 silicate with a particle size which allows 80% of the silicate to pass through a 100 mesh screen and be retained on a 325 mesh screen. Formula 1 used PQ grade H-24 silicate with a particle size which allows 95% of the silicate to pass through a 20 mesh screen and be retained on a 100 mesh screen.

Each formula was used to wash clothes in a Maytag washing machine using 60° F. water. 160 grams of detergent was used to wash approximately 5 lbs. of clothing in 17 gallons of water. At the end of a complete wash/rinse cycle, any insoluble detergent lumps left in the machine were removed and weighed. Formula 1 according to the invention using coarse silicate gave practically no lumps whereas Formula A using the conventional fine silicate gave, on the average, 30.4 grams of product lumps per wash.

The number of grams of detergent left at end of wash/rinse cycles at 60° F. in a Maytag washing machine according to the invention is as follows:

| Run # | Formula A | Formula 1 |
|---|---|---|
| 1 | 27.9 gm. | 0 |
| 2 | 23.3 gm. | 0 |
| 3 | 28.2 gm. | 0 |
| 4 | 27.6 gm. | 0.5 gm. |
| 5 | 44.9 gm. | 0 |
| AVERAGE | 30.4 gm. | 0.1 gm. |

EXAMPLE

Two dry blended laundry detergents were made by the following process according to the following method. To a 16 quart pilot plant V-shell blender all the below listed dry ingredients from Table B were added and blended for 30 seconds. Onto this dry mixture a blend of sulfuric acid, sulfuric acid ester of ethoxylated alcohol, and ethoxylated alcohol were sprayed over about 4 minutes. Perfume was sprayed on the mix for about 30 seconds and blending was continued an additional 1 minute. The finished product was discharged from the blender and packaged.

TABLE B

| | Form of Ingredient | % (Wt.) |
|---|---|---|
| soda ash | Dry | 81.9 |
| sodium bicarbonate | Dry | 5.0 |
| hydrous sodium silicate | Dry | 3.8 |
| sodium carboxymethyl cellulose | Dry | 0.34 |
| polyvinyl alcohol | Dry | 0.34 |
| optical brightener | Dry | 0.27 |
| sulfuric acid | Wet | 1.6 |
| sulfuric acid ester of ethoxylated alcohol | Wet | 4.2 |
| ethoxylated long chain alcohol | Wet | 2.5 |
| perfume | Wet | 0.1 |
| TOTAL | | 100.00% |

Formula B used PQ grade C-24 silicate with a particle size which allows 70% of the silicate to pass through a 200 mesh screen and be retained on a 325 mesh screen. Formula 2 used PQ grade H-24 silicate with a particle size which allows 95% of the silicate to pass through a 20 mesh screen and be retained on a 100 mesh screen.

Each formula was used to wash clothes in a Maytag washing machine using 45° F. water. 145 grams of detergent was used to wash approximately 5 lbs. of clothing in 17 gallons of water. At the end of a complete wash/rinse cycle, any soluble detergent lumps left in the machine were removed and weighed. Formula 2 according to the invention using coarse silicate gave very small lumps where Formula B using the conventional fine silicate gave, on the average, 40.5 grams of product lumps per wash.

The number of grams of detergent left at the end of wash/rinse cycles at 45° F. in a Maytag washing machine according to the invention is as follows:

| Run # | Formula B | Formula 2 |
|---|---|---|
| 1 | 27.6 gm. | 6.4 gm. |
| 2 | 45.5 | 3.8 |
| 3 | 41.4 | 2.9 |

-continued

| Run # | Formula B | Formula 2 |
|---|---|---|
| 4 | 35.8 | 7.8 |
| 5 | 52.1 | 5.5 |
| AVERAGE | 40.5 gm. | 5.3 gm. |

What is claimed:

1. A method of substantially completely preventing the formation of undissolved laundry detergent masses in cold wash water having a temperature of the order of about 35° F. to about 75° F., said laundry detergent being a dry blended carbonate detergent formulation of finely-divided powders and containing unhydrated or partially hydrated builder salts; from 2–10% by weight of a pH buffering or pH lowering compound; and from 5–20% by weight of a synthetic anionic, nonionic, amphoteric or zwitterionic detergent active compound;

said method consisting essentially in adding from about 3 to about 25 percent by weight of coarse, hydrous granular water soluble silicate particles of which about 100% pass a 10 mesh screen, about 95% are retained on a 100 mesh and no greater than about 4% pass through a 100 mesh screen, and wherein the ratio of $SiO_2$:$Na_2O$ in said silicate is in the range of about 1:1 to about 3.5:1.

2. The method as claimed in claim 1 wherein the amount of detergent active compounds is in the range of about 5% to about 10% by weight.

3. A method of substantially completely preventing the formation of undissolved laundry detergent masses in cold wash water having a temperature of the order of about 35° F. to about 75° F., said laundry detergent being a dry blended phosphate detergent formulation of finely-divided powders and containing unhydrated or partially hydratable builder salts, and from 5% to 20% by weight of a synthetic anionic, nonionic, amphoteric or zwitterionic detergent active compound;

said method consisting essentially in adding from about 3 to about 25 percent by weight of coarse, granular water soluble silicate particles of which about 100% pass a 10 mesh screen, about 95% are retained on a 100 mesh screen and no greater than about 4% pass through a 100 mesh screen, and wherein the ratio of $SiO_2$:$Na_2O$ in said silicate is in the range of 1:1 to about 3.5:1.

4. The method as claimed in claim 3 wherein the amount of detergent active compound is in the range of about 5% up to about 10% by weight.

5. The method as claimed in claim 1 wherein the detergent composition is by weight percent:

| | |
|---|---|
| soda ash | 60.0% |
| sodium bicarbonate | 5.7 |
| sodium sesquicarbonate | 18.0 |
| hydrous sodium silicate | 6.8 |
| sodium alkyl benzene sulfonate, flake | 2.0 |
| alkyl benzene sulfonic acid | 4.0 |
| ethoxylated long chain alcohol | 3.0 |
| miscellaneous brighteners, anti-redeposition agents, and perfumes | 0.52 |
| | 100.00% |

6. The method as claimed in claim 1 wherein the detergent composition is by weight percent:

| | |
|---|---|
| soda ash | 78.2% |
| sodium bicarbonate | 5.0 |
| hydrous sodium silicate | 7.5 |
| sulfuric acid | 1.6 |
| sulfuric acid ester of ethoxylated long chain alcohol | 4.2 |
| ethosylated long chain alcohol | 2.5 |
| miscellaneous brighteners, anti-redeposition agents, and perfumes | 1.0 |
| | 100.00% |

* * * * *